US008471778B2

(12) United States Patent
Huang et al.

(10) Patent No.: US 8,471,778 B2
(45) Date of Patent: Jun. 25, 2013

(54) SOLID DUAL-BAND ANTENNA DEVICE

(75) Inventors: Chih-Yung Huang, Dongshih Township, Taichung County (TW); Wen-Szu Tao, Hsinchu (TW); Kuo-Chang Lo, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 872 days.

(21) Appl. No.: 12/548,520

(22) Filed: Aug. 27, 2009

(65) Prior Publication Data

US 2010/0079351 A1 Apr. 1, 2010

(30) Foreign Application Priority Data

Sep. 9, 2008 (TW) ..... 97134612 A

(51) Int. Cl.
*H01Q 1/48* (2006.01)

(52) U.S. Cl.
USPC ..... 343/846; 343/702

(58) Field of Classification Search
USPC ..... 343/846, 702
See application file for complete search history.

(56) References Cited

U.S. PATENT DOCUMENTS 7,576,698 B2 * 8/2009 Cheng ..... 343/700 MS
7,969,362 B2 * 6/2011 Huang et al. ..... 343/700 MS
8,144,062 B2 * 3/2012 Ke et al. ..... 343/702

* cited by examiner

*Primary Examiner* — Hoang V Nguyen
*Assistant Examiner* — Kyana R McCain
(74) *Attorney, Agent, or Firm* — Gottlieb, Rackman & Reisman, P.C.

(57) ABSTRACT

A solid dual-band antenna device is provided. The solid dual-band antenna device includes a Z-shape antenna structure comprising a first turn having a first turning angle, and connected to a ground portion and a first radiating portion; and a second turn having a second turning angle, and connected to the first radiating portion and a second radiating portion; a feeding portion disposed at the second turn for feeding a signal; an extending ground portion non-coplanarly extended from an outer side of the ground portion; and an extending radiating portion non-coplanarly extended from an outer side of the second radiating portion, wherein a first slot is disposed at an arbitrary position of the second radiating portion, and a length of the first radiating portion is different from a length of the second radiating portion.

30 Claims, 5 Drawing Sheets

SOLID DUAL-BAND ANTENNA DEVICE

FIELD OF THE INVENTION

The present invention relates to an antenna device, and more particularly to a solid dual-band antenna device.

BACKGROUND OF THE INVENTION

Nowadays, the size of the hand-held electronic device (e.g. the cellphone or the notebook computer) or the wireless communication device (e.g. AP) is getting smaller and smaller. Many kinds of small-sized antennas have been developed in response to the demand for small-sized products. Selecting proper antennas according to the types and requirements of the products not only helps to enhance the transmission efficiency, but also further reduces the production cost. For example, the planar inverse-F antenna (PIFA), which is light, has good transmission efficiency and can be easily disposed at the inner wall of the hand-held electronic device, has been widely applied in many kinds of hand-held electronic devices or wireless communication devices for wireless communication. The transmission method of PIFA is performed by transmitting the ground signal and the signals intended to be transmitted by PIFA via the outer conduction layer and the inner conducting layer of the coaxial cable, respectively. In the prior art, the outer conducting layer and the inner conducting layer of the coaxial cable are welded on the signal ground point and the signal feeding point of PIFA respectively, so as to output the signals intended to be transmitted via PIFA. However, the bandwidth and the frequency segment provided by PIFA are narrower.

In order to overcome the drawbacks in the prior art, a solid dual-band antenna device is provided. The particular design in the present invention not only solves the problems described above, but also is easy to be implemented. Thus, the present invention has the utility for the industry.

SUMMARY OF THE INVENTION

In accordance with one aspect of the present invention, a solid dual-band antenna device is provided. Compared with other planar antenna devices, the solid dual-band antenna device of the present invention can provide a larger antenna output gain, and has a larger bandwidth and a stable dual frequency segment. Therefore, the entire efficiency of the solid dual-band antenna device of the present invention is enhanced and the application range thereof is enlarged.

In accordance with another aspect of the present invention, a solid dual-band antenna device is provided which can effectively overcome the drawbacks in the prior art. The fabrication processes of the solid dual-band antenna device of the present invention are simple. Besides, since the solid dual-band antenna device of the present invention has a larger bandwidth, it can be applied in more wireless communication fields, which is difficult to be achieved by other antenna devices, especially a planar antenna device.

In accordance with a further aspect of the present invention, a solid dual-band antenna device is provided. The solid dual-band antenna device includes an antenna structure. The antenna structure includes a ground portion having a first side and a second side opposite to the first side; an extending ground portion non-coplanarly extended from the first side, wherein a first included angle is formed by an intersection of the ground portion and the extending ground portion; a first radiating portion having a first length, a first end, a second end, a third side adjacent to the second side, and a fourth side opposite to the third side, wherein a second included angle is formed by an intersection of the second side and the third side; a second radiating portion having a second length, a third end, a fourth end, a fifth side adjacent to the fourth side, and a sixth side opposite to the fifth side, wherein a third included angle is formed by an intersection of the fourth side and the fifth side so that the ground portion, the first radiating portion and the second radiating portion present an S-shape or a Z-shape on a plane; a first slot disposed at an arbitrary position of the second radiating portion; an extending radiating portion non-coplanarly extended from the sixth side, wherein a fourth included angle is formed by an intersection of the second radiating portion and the extending radiating portion; and a feeding portion disposed at an junction of the second end and the third end, wherein the first length is different from the second length.

Preferably, the solid dual-band antenna device further includes a substrate made of a non-metal and non-magnetic material for disposing the antenna structure thereon so as to have an enhanced strength.

Preferably, the solid dual-band antenna device further includes a supporting device made of a non-metal and non-magnetic material, wherein the supporting device is disposed in a space formed by the plane, the extending ground portion and the extending radiating portion.

Preferably, the first included angle is 90 degrees.

Preferably, the second included angle is a factor determining that a bandwidth of the first radiating portion is ranged between 4.5 GHz and 6.0 GHz.

Preferably, the first length determines an initiating frequency of the first radiating portion.

Preferably, the second length determines an initiating frequency of the second radiating portion.

Preferably, the second length is shorter than the first length.

Preferably, the third included angle is a factor determining that a bandwidth of the second radiating portion is ranged between 2.3 GHz and 3.0 GHz.

Preferably, the first slot is in a shape of at least one selected from a group consisting of a rectangle, a circle, a polyhedron and an irregular form.

Preferably, the first slot is extended to the extending radiating portion.

Preferably, the fourth included angle is 90 degrees.

Preferably, a length of the extending radiating portion is equal to the second length.

Preferably, the extending radiating portion has a second slot disposed at an arbitrary position thereof.

Preferably, the extending radiating portion has a second slot which does not intersect the first slot for separating the extending radiating portion into two parts.

Preferably, the two parts have different heights.

Preferably, the ground portion, the extending ground portion, the first radiating portion, the second radiating portion and the extending radiating portion are made in one piece.

In accordance with further another aspect of the present invention, a solid dual-band antenna device is provided. The solid dual-band antenna device includes a Z-shape antenna structure comprising a first turn having a first turning angle, and connected to a ground portion and a first radiating portion; and a second turn having a second turning angle, and connected to the first radiating portion and a second radiating portion; a feeding portion disposed at the second turn for feeding a signal; an extending ground portion non-coplanarly extended from an outer side of the ground portion; and an extending radiating portion non-coplanarly extended from an outer side of the second radiating portion, wherein a first slot is disposed at an arbitrary position of the second radiating portion, and a length of the first radiating portion is different from a length of the second radiating portion.

Preferably, the solid dual-band antenna device further includes a substrate made of a non-metal and non-magnetic material for disposing the Z-shape antenna structure thereon so as to enhance a strength of the Z-shape antenna structure.

Preferably, the solid dual-band antenna device further includes a supporting device made of a non-metal and non-magnetic material, wherein the supporting device is disposed in a space formed by the Z-shape antenna structure, the extending ground portion and the extending radiating portion.

Preferably, the first turning angle is a factor determining that a bandwidth of the first radiating portion is ranged between 4.5 GHz and 6.0 GHz.

Preferably, the length of the first radiating portion is greater than the length of the second radiating portion.

Preferably, the second turning angle is a factor determining that a bandwidth of the second radiating portion is ranged between 2.3 GHz and 3.0 GHz.

Preferably, the first slot is in a shape of at least one selected from a group consisting of a rectangle, a circle, a polyhedron and an irregular form.

Preferably, the first slot is extended to the extending radiating portion.

Preferably, the extending radiating portion has a second slot disposed at an arbitrary position thereof.

Preferably, the extending radiating portion has a second slot which does not intersect the first slot for separating the extending radiating portion into two parts.

Preferably, the two parts have different heights.

Preferably, a length of the extending radiating portion is equal to the length of the second radiating portion.

Preferably, the Z-shape antenna structure, the extending ground portion and the extending radiating portion are made in one piece.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
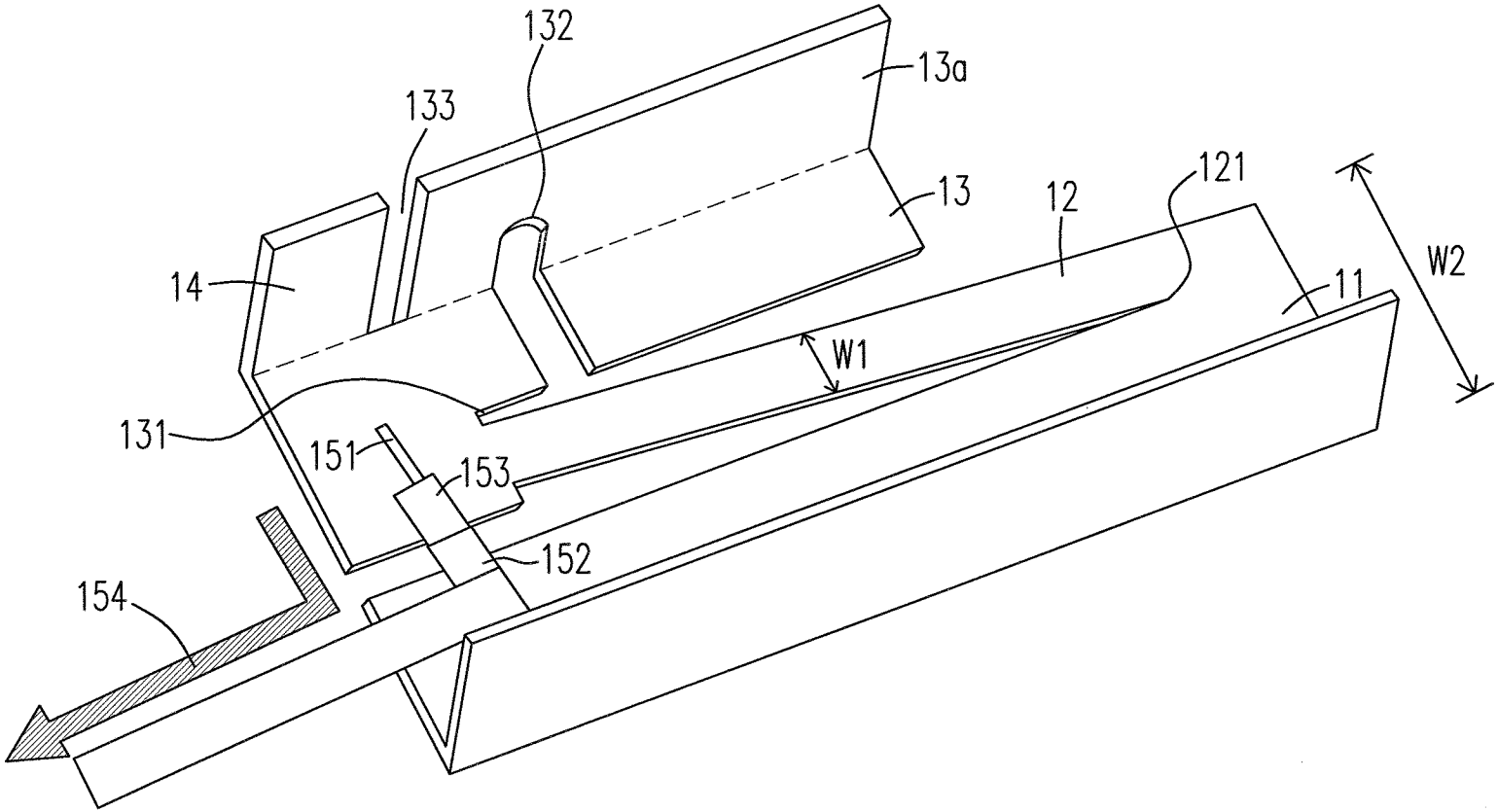
FIG. 1 is a schematic diagram showing the solid dual-band antenna device according to a first embodiment of the present invention.

Please refer to FIG. 1, which is a schematic diagram showing the solid dual-band antenna device according to a first embodiment of the present invention. The solid dual-band antenna device 1 mainly includes three portions made of metal, a ground portion 11 in an L-shape, a high-frequency radiating portion 12 corresponding to a high-frequency range, and a low-frequency radiating portion 13 in an L-shape and corresponding to a low-frequency range. The high-frequency radiating portion 12 intersects the ground portion 11 to form a high-frequency included angle 121 for controlling the bandwidth of the high-frequency band. The high-frequency radiating portion 12 intersects the low-frequency radiating portion 12 to form a low-frequency included angle 131 for controlling the bandwidth of the low-frequency band. The ratio of length to width of the high-frequency radiating portion 12 and that of the low-frequency radiating portion 13 in this embodiment are only examples, which can be modified according to the frequency segments and characteristics of the products. For example, modifying the lengths of the high-frequency radiating portion 12 and the low-frequency radiating portion 13 can change the initiating frequencies of the high-frequency band and the low-frequency band respectively, thereby achieving the proper operating frequency. For simplifying the fabrication processes, the ground portion 11, the high-frequency radiating portion 12 and the low-frequency radiating portion 13 can be made in one piece.

The voltage standing wave ratio (VSWR) is a ratio of the reflection power to the input power. The high VSWR often results from the poor impedance matching between two devices connected with each other in the wireless radio frequency (RF) system. Since the poor impedance matching may easily cause the transmission signal to be weaker and lower than the expected value, the solid dual-band antenna device of the present invention provides many technical features for improving the problem of poor impedance matching. For the high frequency, the impedance matching of the high-frequency band can be changed by adjusting the line width W1 of the high-frequency radiating portion 12, the width W2 of the turn between the high-frequency portion 12 and the ground portion 11, or the bending structure 14 at the end of the high-frequency radiating portion 12, so as to achieve a better VSWR. For the low frequency, a first slot 132 and a second slot 133 are disposed in the low-frequency radiating portion 13, and the impedance matching of the low-frequency band can be changed by adjusting the lengths, widths, shapes or extending paths of the first slot 132 and the second slot 133, so as to achieve a better VSWR. The problem of poor impedance matching in the antenna device can be improved by adjusting the above-mentioned valuables. Hence, the solid dual-band antenna device of the present invention can provide a better antenna efficient gain.

Another advantage of the present invention is that the present invention has a wider bandwidth, which has a great influence on the application range of the product. Since the present invention has the technical features of the bending structure 14 at the end of the high-frequency radiating portion 12, the bending structure 13*a* of the low-frequency radiating portion 13, the high-frequency included angle 121, the low-frequency included angle 131 and the first slot 132, it has a wider antenna bandwidth. Secondly, compared with the planar antenna device, the solid dual-band antenna device of the present invention can provide a wider bandwidth. Moreover, as described above, the present invention can effectively improve the problem of poor impedance matching in the antenna device. This not only provides a better antenna efficient gain but also increases the bandwidth of the solid dual-band antenna device of the present invention.

Please refer to FIG. 1 again. The RF signal feeding terminal and the RF signal feeding ground terminal of the present invention are positioned at the high-frequency/low-frequency radiating portions 12, 13 and the ground portion 11 respectively. In the present invention, the RF feeding signal enters the antenna device via the center signal line 151 of the coaxial cable and are grounded via the ground terminal 152 of the coaxial cable, wherein an intermediate insulating layer 153 of the coaxial cable is welded between the center signal line 151 of the coaxial cable and the ground terminal 152 of the coaxial cable as a separation. Finally, the RF feeding signal leaves the antenna device via the line exiting direction 154 of the coaxial cable.

Figure 2:
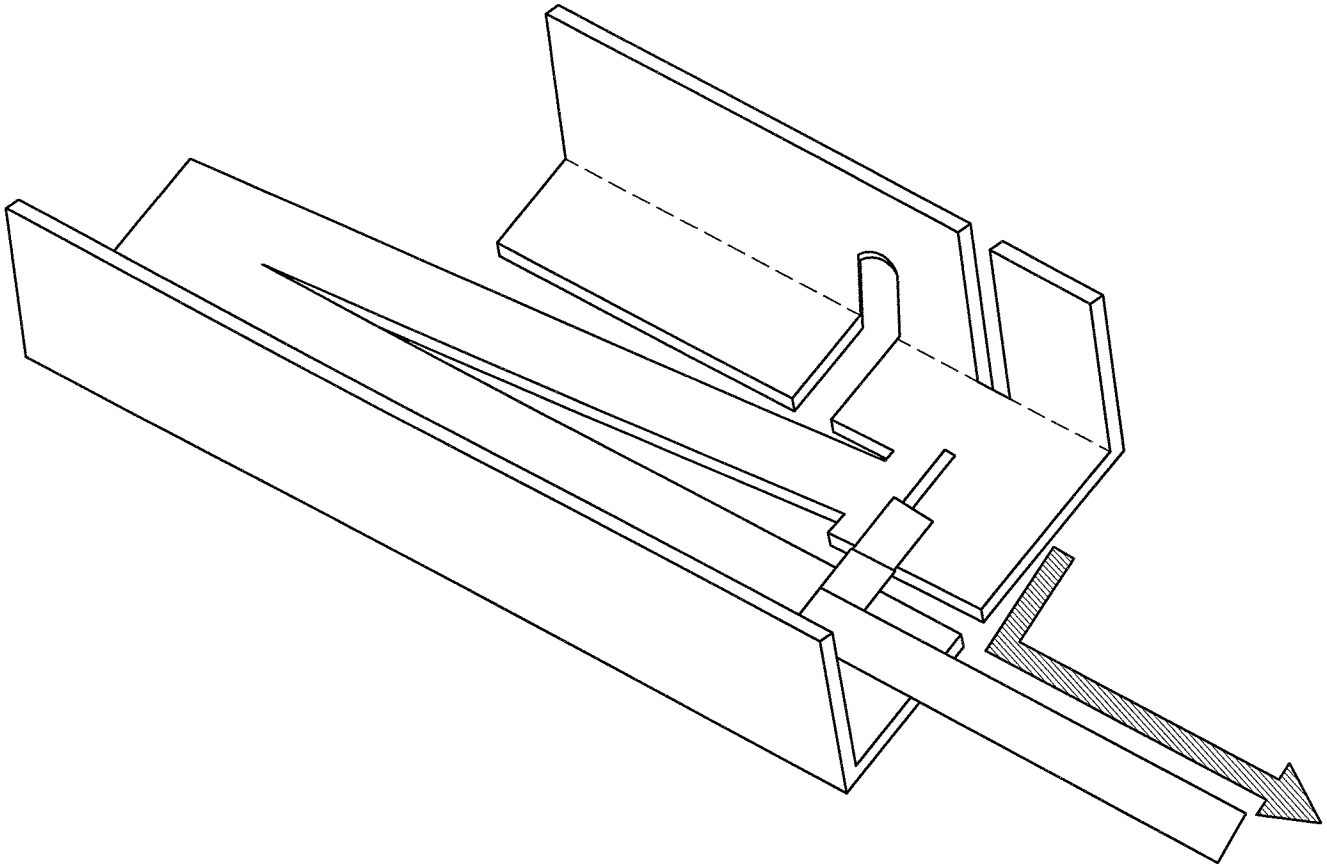
FIG. 2 is a schematic diagram showing the solid dual-band antenna device according to a second embodiment of the present invention.

Please refer to FIG. 2, which is a schematic diagram showing the solid dual-band antenna device according to a second embodiment of the present invention. FIG. 2 is a mirror image diagram of FIG. 1, and the structure of the solid dual-band antenna device in FIG. 2 is identical to that in FIG. 1. However, the solid dual-band antenna device in FIG. 2 has a line exiting direction opposite to that of the solid dual-band antenna device in FIG. 1 for accommodating different products.

Figure 3:
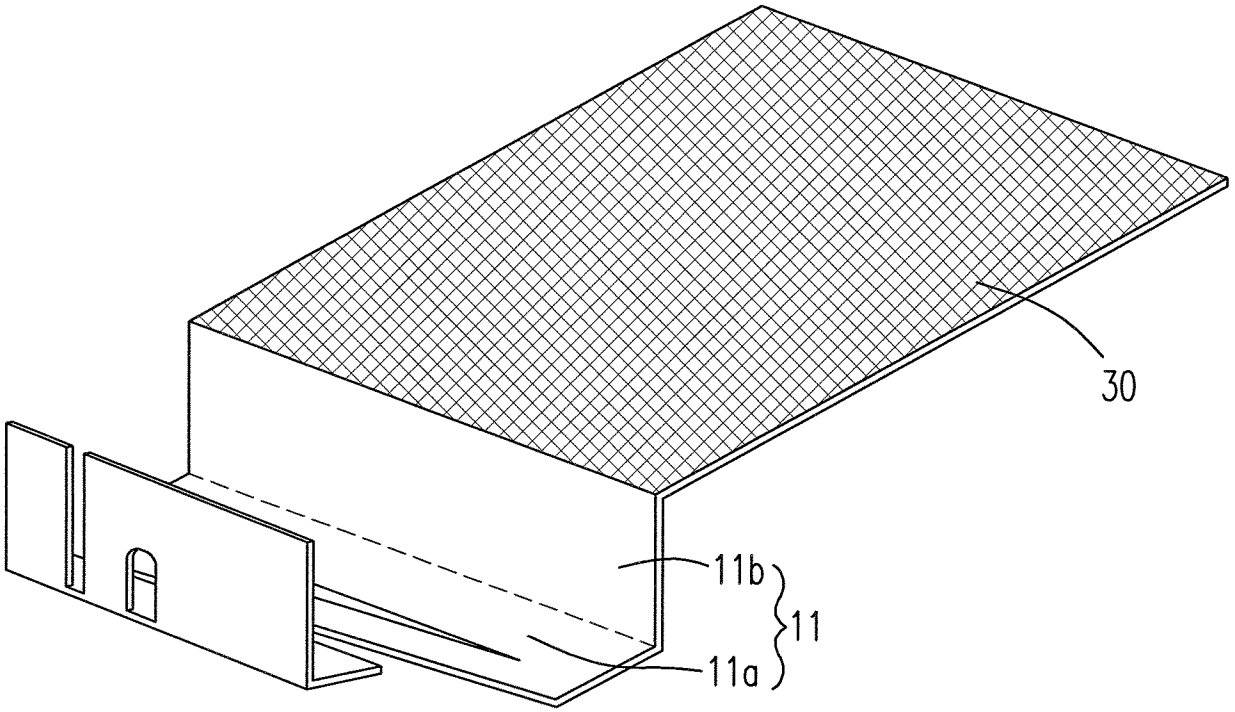
FIG. 3 is a schematic diagram showing the solid dual-band antenna device according to a third embodiment of the present invention.

Please refer to FIG. 3, which is a schematic diagram showing the solid dual-band antenna device according to a third embodiment of the present invention. The structure of the solid dual-band antenna device in FIG. 3 is similar to that in FIG. 1, wherein the ground portion 11 includes a planar ground portion 11*a* and an extending ground portion 11*b* extended from a side of the planar ground portion 11*b*. The extending ground portion 11*b* is further connected to a ground aluminum foil 30 at the opposite side of the planar ground portion 11*a*. The ground portion 11 of the solid dual-band antenna device of the present invention can be connected to the ground structure of the system via the ground aluminum foil 30.

Figure 4:
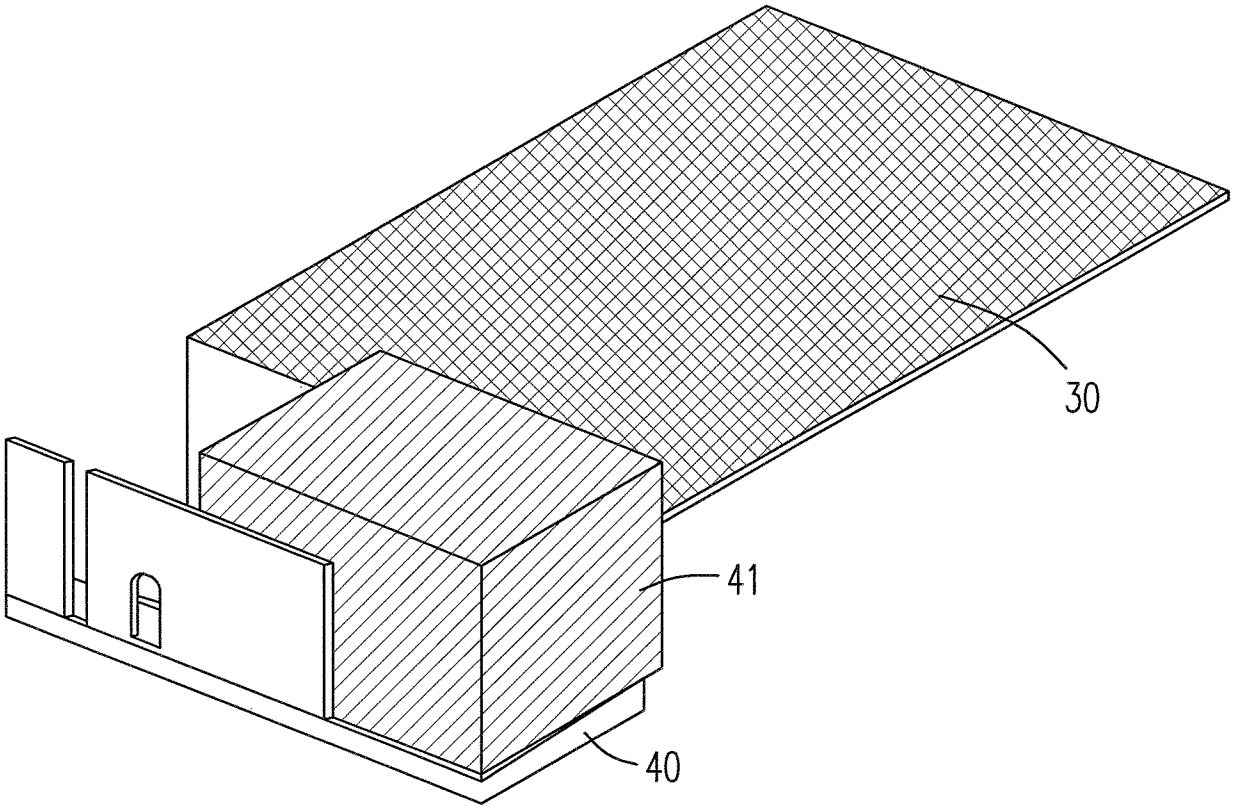
FIG. 4 is a schematic diagram showing the solid dual-band antenna device according to a fourth embodiment of the present invention.

Please refer to FIG. 4, which is a schematic diagram showing the solid dual-band antenna device according to a fourth embodiment of the present invention. For increasing the strength of the solid dual-band antenna device of the present invention and preventing it from deformation, this embodiment is to dispose the solid dual-band antenna device of FIG. 3 on a substrate 40 and dispose a supporting device 41 on the solid dual-band antenna device. Generally, the materials of the substrate 41 and the supporting device 41 are non-metal and non-magnetic materials, especially the cotton. The supporting device 41 not only enhances the strength of the antenna device, but also facilitates the assembly of the present invention. For example, when the present invention is applied to the notebook computer, the supporting device 41 can provide the force-applying point for the antenna device to be assembled in the notebook computer.

Figure 5:
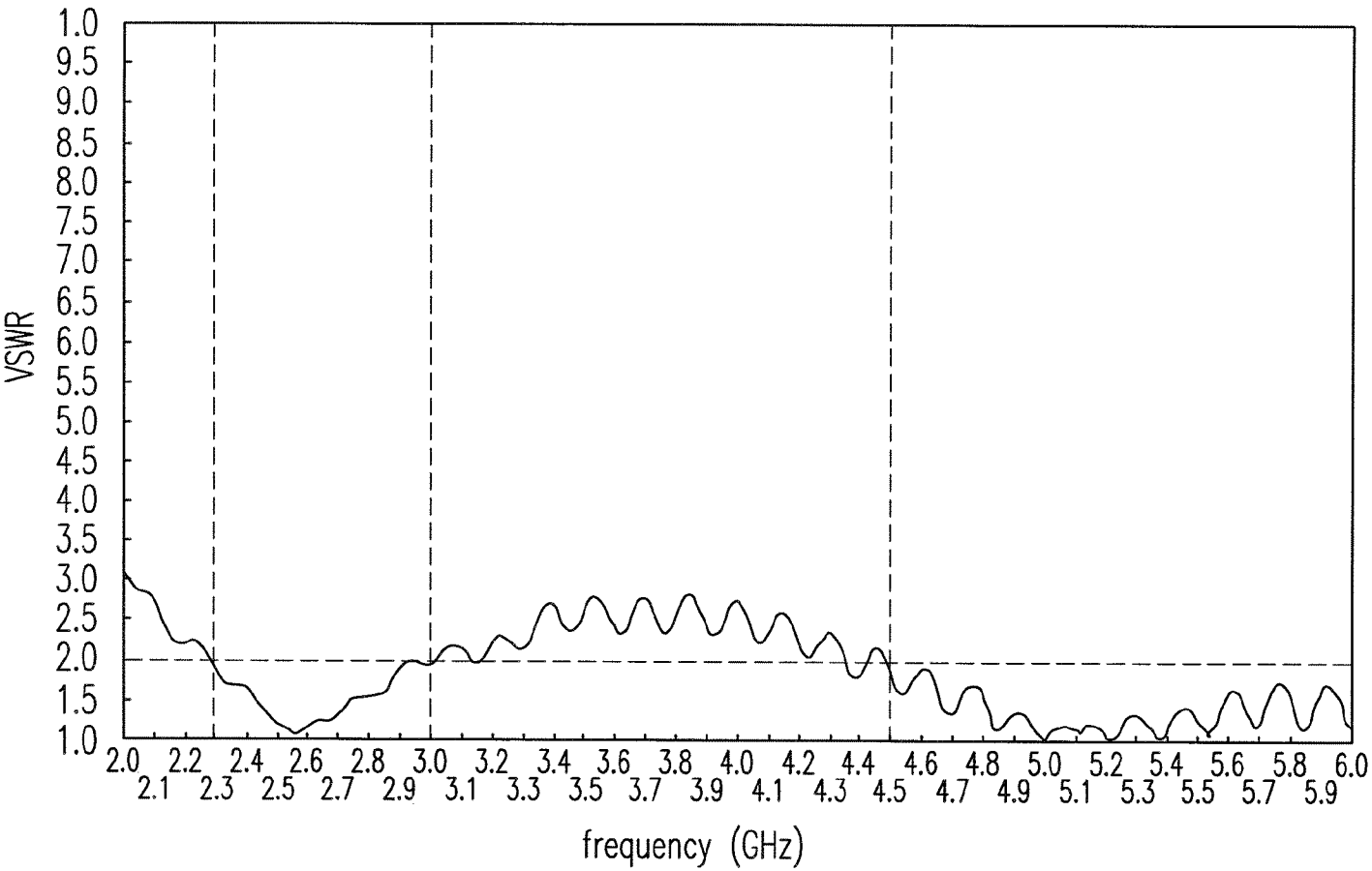
FIG. 5 shows the voltage standing wave ratio according to the first embodiment of the present invention.

Please refer to FIG. 5, which shows the voltage standing wave ratio according to the first embodiment of the present invention. As shown in FIG. 5, the frequency range of the VSWR of the present invention below 2 includes the low-frequency range of 2.3 GHz~3.0 GHz and the high-frequency range of 4.5 GHz~6.0 GHz. This means the present invention can provide the low-frequency bandwidth of 700 MHz and the high-frequency bandwidth of 1.5 GHz. In the present invention, the dual-band effect for the operating frequency segments of 2.3 GHz~3.0 GHz and 4.5 GHz~6.0 GHz can be achieved by the different paths for the RF feeding signal. Since the above-mentioned bandwidths have entirely covered the bandwidth ranges required by the wireless communication technologies such as the IEEE 802.11a/b/g/n wireless network standard, Wimax, Bluetooth, etc., so that the application range of the present invention is quite wide.

Based on the above, the present invention effectively solves the problems and drawbacks in the prior art, and thus it fits the demand of the industry and is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A solid dual-band antenna device, comprising:

an antenna structure, comprising:

a ground portion having a first side and a second side opposite to the first side;

an extending ground portion non-coplanarly extended from the first side, wherein a first included angle is formed by an intersection of the ground portion and the extending ground portion;

a first radiating portion having a first length, a first end, a second end, a third side adjacent to the second side, a fourth side opposite to the third side, and a seventh side disposed along a specific line, wherein a second included angle is formed by an intersection of the second side and the third side;

a second radiating portion having a second length, a third end, a fourth end, a fifth side adjacent to the fourth side, and a sixth side opposite to the fifth side, wherein the sixth side is disposed along the specific line, and a third included angle is formed by an intersection of the fourth side and the fifth side so that the ground portion, the first radiating portion and the second radiating portion present an S-shape or a Z-shape on a first plane;

a first slot disposed at an arbitrary position of the second radiating portion;

an extending radiating portion having an eighth side opposite to the sixth side and the seventh side and non-coplanarly extended from the sixth side and the seventh side, wherein a fourth included angle is formed by an intersection of the second radiating portion and the extending radiating portion, wherein the extending radiating portion has a second slot extended from the eighth side to one of the sixth side and the seventh side; and a feeding portion disposed at an junction of the second end and the third end, wherein the first length is different from the second length.

2. A solid dual-band antenna device as claimed in claim 1, further comprising a substrate made of a non-metal and non-magnetic material for disposing the antenna structure thereon so as to have an enhanced strength.

3. A solid dual-band antenna device as claimed in claim 1, further comprising a supporting device made of a non-metal and non-magnetic material, wherein the supporting device is disposed in a space formed by the first plane, the extending ground portion and the extending radiating portion.

4. A solid dual-band antenna device as claimed in claim 1, wherein the first included angle is 90 degrees.

5. A solid dual-band antenna device as claimed in claim 1, wherein the second included angle is a factor determining that a bandwidth of the first radiating portion is ranged between 4.5 GHz and 6.0 GHz.

6. A solid dual-band antenna device as claimed in claim 1, wherein the first length determines an initiating frequency of the first radiating portion.

7. A solid dual-band antenna device as claimed in claim 1, wherein the second length determines an initiating frequency of the second radiating portion.

8. A solid dual-band antenna device as claimed in claim 1, wherein the second length is shorter than the first length.

9. A solid dual-band antenna device as claimed in claim 1, wherein the third included angle is a factor determining that a bandwidth of the second radiating portion is ranged between 2.3 GHz and 3.0 GHz.

10. A solid dual-band antenna device as claimed in claim 1, wherein the first slot is in a shape of at least one selected from a group consisting of a rectangle, a circle, a polyhedron and an irregular form.

11. A solid dual-band antenna device as claimed in claim 1, wherein the first slot is extended to the extending radiating portion.

12. A solid dual-band antenna device as claimed in claim 1, wherein the fourth included angle is 90 degrees, and the specific line is formed by an intersection of the extending radiating portion and the first and the second radiating portions.

13. A solid dual-band antenna device as claimed in claim 1, wherein a length of the extending radiating portion is equal to the second length.

14. A solid dual-band antenna device as claimed in claim 1, wherein the second slot is disposed at an arbitrary position of the extending radiating portion.

15. A solid dual-band antenna device as claimed in claim 1, wherein the second slot does not intersect the first slot.

16. A solid dual-band antenna device as claimed in claim 15, wherein the two parts have different heights.

17. A solid dual-band antenna device as claimed in claim 1, wherein the ground portion, the extending ground portion, the first radiating portion, the second radiating portion and the extending radiating portion are made in one piece.

18. A solid dual-band antenna device, comprising:

a Z-shape antenna structure, comprising:

a first turn having a first turning angle, and connected to a ground portion and a first radiating portion; and a second turn having a second turning angle, and connected to the first radiating portion and a second radiating portion;

a feeding portion disposed at the second turn for feeding a signal;

an extending ground portion non-coplanarly extended from an outer side of the ground portion; and an extending radiating portion having a first side opposite to a first outer side of the first radiating portion and second outer side of the second radiating portion and non-coplanarly extended from the first outer side and the second outer side, wherein the first outer side and the second outer side are disposed along a specific line, a first slot is disposed at an arbitrary position of the second radiating portion, and a length of the first radiating portion is different from a length of the second radiating portion, wherein the extending radiating portion has a second slot extended from the first side to one of the first outer side and the second outer side.

19. A solid dual-band antenna device as claimed in claim 18, further comprising a substrate made of a non-metal and non-magnetic material for disposing the Z-shape antenna structure thereon so as to enhance a strength of the Z-shape antenna structure.

20. A solid dual-band antenna device as claimed in claim 18, further comprising a supporting device made of a non-metal and non-magnetic material, wherein the supporting device is disposed in a space formed by the Z-shape antenna structure, the extending ground portion and the extending radiating portion.

21. A solid dual-band antenna device as claimed in claim 18, wherein the first turning angle is a factor determining that a bandwidth of the first radiating portion is ranged between 4.5 GHz and 6.0 GHz.

22. A solid dual-band antenna device as claimed in claim 18, wherein the length of the first radiating portion is greater than the length of the second radiating portion.

23. A solid dual-band antenna device as claimed in claim 18, wherein the second turning angle is a factor determining that a bandwidth of the second radiating portion is ranged between 2.3 GHz and 3.0 GHz.

24. A solid dual-band antenna device as claimed in claim 18, wherein the first slot is in a shape of at least one selected from a group consisting of a rectangle, a circle, a polyhedron and an irregular form.

25. A solid dual-band antenna device as claimed in claim 18, wherein the first slot is extended to the extending radiating portion.

26. A solid dual-band antenna device as claimed in claim 18, wherein the second slot is disposed at an arbitrary position of the extending radiating portion, and the specific line is formed by an intersection of the extending radiating portion and the first and the second radiating portions.

27. A solid dual-band antenna device as claimed in claim 18, wherein the second slot does not intersect the first slot.

28. A solid dual-band antenna device as claimed in claim 27, wherein the two parts have different heights.

29. A solid dual-band antenna device as claimed in claim 18, wherein a length of the extending radiating portion is equal to the length of the second radiating portion.

30. A solid dual-band antenna device as claimed in claim 18, wherein the Z-shape antenna structure, the extending ground portion and the extending radiating portion are made in one piece.

* * * * *